US007299660B2

(12) United States Patent
Stark et al.

(10) Patent No.: US 7,299,660 B2
(45) Date of Patent: Nov. 27, 2007

(54) KNITTING MACHINE

(75) Inventors: Jörg Stark, Oberlungwitz (DE); Frank Friedrich, Chemnitz (DE)

(73) Assignee: Karl Mayer Malimo Textilmaschinenfabrik GmbH, Chemnitz (DE)

( * ) Notice: Subject to any disclaimer, the term of this patent is extended or adjusted under 35 U.S.C. 154(b) by 15 days.

(21) Appl. No.: 11/211,536

(22) Filed: Aug. 26, 2005

(65) Prior Publication Data

US 2006/0042324 A1 Mar. 2, 2006

(30) Foreign Application Priority Data

Aug. 27, 2004 (DE) ..... 10 2004 041 401

(51) Int. Cl.
*D04B 23/12* (2006.01)

(52) U.S. Cl. ..... 66/84 A

(58) Field of Classification Search ..... 66/84 A, 66/84 R, 203
See application file for complete search history.

(56) References Cited

U.S. PATENT DOCUMENTS 3,680,332 A 8/1972 Bassist
4,189,811 A * 2/1980 Cole ..... 66/84 A
4,249,981 A * 2/1981 Pelletier et al. ..... 66/84 A
4,348,876 A * 9/1982 Roth ..... 66/84 A
4,872,323 A * 10/1989 Wunner ..... 66/84 A
5,047,109 A * 9/1991 Krueger ..... 66/84 A
6,668,596 B1 * 12/2003 Wagener ..... 66/84 A

FOREIGN PATENT DOCUMENTS

DE 2134022 1/1972
DE 10031836 1/2002

* cited by examiner

*Primary Examiner*—Danny Worrell
(74) *Attorney, Agent, or Firm*—Gernblum & Bernstein, P.L.C.

(57) ABSTRACT

Knitting machine with a knitting area and a weft feed device and knitting process. The machine includes a conveyor device structured and arranged to feed wefts to a knitting area in a transport direction, in which the conveyor device includes several transport elements with thread holders. The transport elements are separate from one another and joinable to form a feed assembly through a functional area in the transport direction and individually movable in a returning area.

22 Claims, 9 Drawing Sheets

KNITTING MACHINE

CROSS-REFERENCE TO RELATED APPLICATIONS

The present application claims priority under 35 U.S.C. §119 of German Patent Application No. 10 2004 041 401.7-26, filed on Aug. 27, 2004, the disclosure of which is expressly incorporated by reference herein in its entirety.

BACKGROUND OF THE INVENTION

1. Field of the Invention

The invention relates to a knitting machine with a knitting area and a weft feed device, which has a conveyor device with which wefts can be fed in a transport direction to the knitting area.

2. Discussion of Background Information

The weft feed device deposits wefts on the conveyor device crosswise to the transport direction or at an angle to the transport direction deviating from 90°. If several weft groups are deposited with different angles, this is also referred to as "multiaxial knitting machines." The knitting area, which forms the working area of the knitting machine in the narrower sense, is where all the processes occur that are relevant in terms of textile technology. Here the wefts are tied into a knitted fabric, or the wefts, which at first rest on the conveyor device next to one another, are connected to one another by knitting processes to form a fabric material.

The conveyor device usually comprises two or more circulating bands or chains which extend parallel to the transport direction. The bands carry thread holders. In the simplest case, the thread holders are embodied as hook-like elements which hold the wefts when they are fed from a cross conveyor.

The design of the conveyor device depends on the type and embodiment of the wefts used. Under some circumstances, when wefts are to be changed, a considerable alteration of the knitting machine is required. As a rule, replacing the conveyor device is associated with a certain amount of effort

SUMMARY OF THE INVENTION

The present invention improves the usability of a knitting machine.

According to the invention, a knitting machine of the type mentioned at the outset includes a conveyor device with several transport elements separate from one another which feature thread holders. The transport elements can be joined together to form a feed assembly in the transport direction in a functional area and can be moved individually in a returning area.

In this embodiment, the conveyor function is divided among several discrete elements. These discrete elements have a comparatively short length, so that they can be handled individually, in particular in the returning area. In the functional area, these individual transport elements are lined up one behind the other and assembled to form a feed assembly. The thread holders located on the transport elements are then lined up, as they also were hitherto, so that the wefts can be inserted with a predetermined pitch. The feed assembly is then fed to the knitting area and the wefts can be tied into a knitted fabric. After passing through the knitting area, the feed assembly can be broken up again so that the individual transport elements can be handled separately again. If a change in the configuration of the conveyor device is necessary, this can be accomplished in a simple manner by replacing the transport elements. Larger conversion measures are not necessary for this.

The transport elements are preferably guided in a closed cycle and are movable in the returning area at a higher speed than in the functional area. It is thus first possible to realize a continuous process The transport elements, which are no longer necessary for the transport of the wefts through the functional area after passing through the functional area, are conveyed back again and are then available for another passage through the functional area. Since the transport elements are conveyed back more quickly than they pass through the functional area, it is possible to considerably reduce the number of transport elements and thus to reduce the cost of the transport elements.

The transport elements in the functional area and in the returning area preferably have the same alignment in the space. This facilitates handling. If the thread holders in the conveyor area are directed upwards, the thread holders also remain directed upwards during the return conveyance. The transport elements can then be supported on the same bearing surface both in the functional area and in the returning area. The risk of damage to the thread holders in the returning area is comparatively small. The thread holders can have different embodiments. They can be hooks, clamping elements, eyelets or other elements that are able to hold the wefts.

The functional area is preferably arranged above the returning area. If the functional area and the returning area are arranged vertically one above the other, this saves space. The floor space required for the knitting machine can be kept small.

The transport elements are preferably guided in a guide track at least in the functional area. At this point it should be noted that corresponding transport elements are provided at least on both sides of the knitting machine parallel to the transport direction in order to hold wefts at both ends. Relatively high demands are made on the guidance of the wefts as far as precision is concerned. This precision can be ensured to a great extent with a guide track. The transport elements are fixed in the guide track, for example, in a positive and non-positive manner. A degree of freedom is left open only in the transport direction. The transport elements are thus guided in the guide track backlash-free, as it were. Adjacent transport elements abut against one another with their front faces in the guide track and thus form the feed assembly.

Preferably at least one control device is arranged in the functional area, which device changes a position of the thread holders essentially crosswise to the transport direction. It is thus possible to increase or reduce the tension of the wefts. If necessary, an equalization of the tension of the wefts can also be achieved with the displacement of the thread holders. A control device can be arranged at only one end of the wefts, i.e., on a side wall of the knitting machine. It is also possible to arrange a corresponding control device at both ends of the wefts. The control device is preferably arranged just in front of the knitting area. However, it is also possible to provide one control device before and one after the knitting area in the transport direction. An arrangement in the knitting area is also possible. The optimal position can be determined by simple tests.

In a preferred embodiment it is provided that the thread holders are arranged moveably on the transport element. The transport elements thus do not need to be moved. The control device acts on the thread holders.

It is hereby preferred for the transport element to have at least one thread holder guide running crosswise to the transport direction. The thread holders can be displaced crosswise to the transport direction in the thread holder guide. The displacement path is relatively small. In principle, a displacement by, e.g., ±2.5 mm is sufficient to realize sufficient influence on the tension. Instead of a linear guide, it can also be provided that the thread holders are arranged on the transport element in a swiveling manner. It should also be possible to include this under the term of the thread holder guide.

Alternatively or additionally it can also be provided that the control device rotates the transport element about an axis that runs parallel to the transport direction. Since the transport elements abut against one another only on the face ends in order to form the feed assembly, such a rotational movement will not mean the feed assembly is changed in the transport direction. The individual transport elements can still abut against one another backlash-free.

It is also advantageous if the control device acts on the guide track. The guide track can be provided, e.g., with an elastically deformable area. The deformability is thereby restricted to the guide track as a whole. The guide track remains inherently stable. The deformation of the guide track influences only the transport elements and thus the thread holders which are currently located in the area of the control device or just before or after it The other transport elements are not influenced, so that the wefts can be fed unchanged. The change in the tension of the wefts then affects only the knitting area, where this is desired.

An input drive is preferably arranged at the start of the functional area and an output drive at the output of the functional area, whereby the input drive and the output drive respectively act on at least one transport element at the start and at the end of the feed assembly. This is a relatively simple embodiment to form a feed assembly. The transport elements that are arranged between the transport element at the start and the transport element at the end of the feed element are not acted on directly by a drive, but only indirectly via respectively one other transport element The transport elements located between the first and the last transport element of the feed assembly can then, e.g., be twisted in order to change the tension of the wefts.

The input drive and the output drive preferably act on the feed assembly in the transport direction with differing forces. This is a simple way of bracing the transport elements together into a feed assembly, even when the transport elements have slight differences in length. Such differences can result, e.g., from a certain amount of wear. When the transport elements are tensioned together in the transport direction in the feed assembly, they abut against one another backlash-free. The alignment of the wefts then corresponds exactly to a specification. The forces of input drive and output drive can easily be adjusted to one another if the electric motors used for the drive have adjustable torque. Depending on the position of the scrim, equal but opposing forces occur in the left and right transport system of the knitting machine. Accordingly, the input and output transmissions of the left and right transport device work differently.

In an alternative or additional embodiment it can be provided that the input drive and the output drive can be displaced with respect to one another. This is another way of compensating for smaller differences in length of the transport elements which as a rule lead to a change in length of the feed assembly of less than 1 mm.

The input drive and/or the output drive preferably has a meshing geometry with a rack and pinion gearing. The rack and pinion gearing is a special form of cycloidal teeth. It is used for very large gear ratios and is suitable only for slow movements. The meshing geometry has at least two meshing wheels braced with respect to one another, which meshing wheels engage backlash-free directly in the meshing means of the transport elements.

It is hereby preferred for each transport element to have at least one projecting bolt. This bolt then acts as a meshing means on the transport element. However, each transport element preferably has more than one bolt so that the rack and pinion gearing of the meshing geometry engages at the same time at several points on the transport element. The bolt can, e.g., project downwards.

In the returning area, a returning device is preferably provided which acts with a friction engagement on the transport elements. In the conveyor area the transport elements have to be moved at a precisely defined speed. As mentioned above, it is thereby important that the transport elements are braced to form the feed assembly. However, during return conveyance, the transport elements can be moved individually. A precise speed control is of lesser importance here. The transport elements can thus be simply laid on a moving belt or a corresponding chain and are then carried along by friction. Of course, a slide rail can also be provided on which the transport elements are returned if they are driven in another manner.

An unloading device is preferably arranged at the output of the output drive, which unloading device detaches a transport element from the feed assembly through a change in the movement direction. If, e.g., the functional area is arranged above the returning area, the transport element is lowered in the transport direction behind the output drive. To this end, e.g., a rotating vertical conveyor can be provided which conveys the transport element to the returning device.

It is hereby preferred for the unloading device to be coupled with a feed limiting device. If the unloading device, e.g., the referenced vertical conveyor, deposits the transport element on the returning device, then in unfavorable circumstances a certain amount of time can pass before the transport element is conveyed away through the friction engagement with the returning device. During this time, the next transport element could then already have been lowered. Through the feed limiting device, it can now be ensured that the transport element is moved out of its initial position virtually directly after the lowering of the transport element onto the returning device. The feed limiting device can thereby, e.g., be coupled with the output drive in order to achieve a certain synchronization. The coupling can also occur by signal when input drive and feed limiting device are controlled by a joint control device.

A feeder device is preferably arranged before the input of the input drive, which feeder device causes a transport element to engage with the input drive. At first the feeder device again causes a change of direction of the transport element. If, for example, the returning area is arranged below the functional area, the feeder device features a lifter that brings the transport element back to the height of the functional area. When the transport element has reached the correct height, it is displaced in the transport direction in order to engage with the input drive.

It is hereby preferred that the feeder device is synchronized with the input drive. Thus only a single transport element is fed at a time to the input drive. Collisions are thus avoided. If the returning area is not arranged below the functional area but, e.g., next to or above it, the movements that the transport element has to carry out at the transition from the functional area to the returning area or vice versa, naturally have to be adjusted accordingly.

The instant invention is directed to a knitting machine with a knitting area and a weft feed device. The machine includes a conveyor device structured and arranged to feed wefts to a knitting area in a transport direction, in which the conveyor device includes several transport elements with thread holders. The transport elements are separate from one another and joinable to form a feed assembly through a functional area in the transport direction and individually movable in a returning area.

In accordance with the invention, the transport elements can be conveyed in a closed cycle.

According to a feature-of the present invention, the transport elements can be moved at a higher speed in the returning area than in the functional area.

In accordance with a further feature of the instant invention, the transport elements can have a same alignment in the functional area and in the returning area.

According to another feature of the invention, the functional area can be arranged above the returning area.

Further, a guide track can be arranged to extend through the functional area. The transport elements may be guided in the guide track at least in the functional area.

Moreover, at least one control device can be arranged in the functional area. The control device may be structured and arranged to change a position of the thread holders essentially crosswise to the transport direction. The thread holders can be movably arranged on the transport element. Further, the transport element may include at least one thread holder guide running crosswise to the transport direction. The control device rotates the transport element about an axis that runs parallel to the transport direction.

In accordance with a further feature of the invention, the control device can be structured and arranged to act on the guide track.

An input drive can be arranged at a start of the functional area relative to the transport direction and an output drive can be arranged at an output of the functional area relative to the transport direction, such that the input drive and the output drive respectively act on at least one of the transport elements at a start and at an end of the feed assembly. The input drive and the output drive can act with differing forces in the transport direction on the feed assembly. Further, the input drive and the output drive may be displaceable with respect to one another. Also, at least one of the input drive and the output drive can include a meshing geometry with a rack and pinion gearing, such that each transport element may include at least one projecting bolt. Further, a returning device, arranged in the returning area, may be structured and arranged to act with friction engagement on the transport elements. Still further, an unloading device, arranged at the output of the output drive, may be structured and arranged to detach a transport element from the feed assembly through a change in a direction of movement A feed limiting device can be coupled to the unloading device. Moreover, a feeder device, arranged before the input of the input drive, can be structured and arranged to engage a transport element with the input drive. The feeder device may be synchronized with the input drive.

The present invention is directed to a knitting process that includes conveying a plurality of transport elements with thread holders joined together to form a feed assembly through a functional area in a transport direction, and individually moving the transport elements in a returning area.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
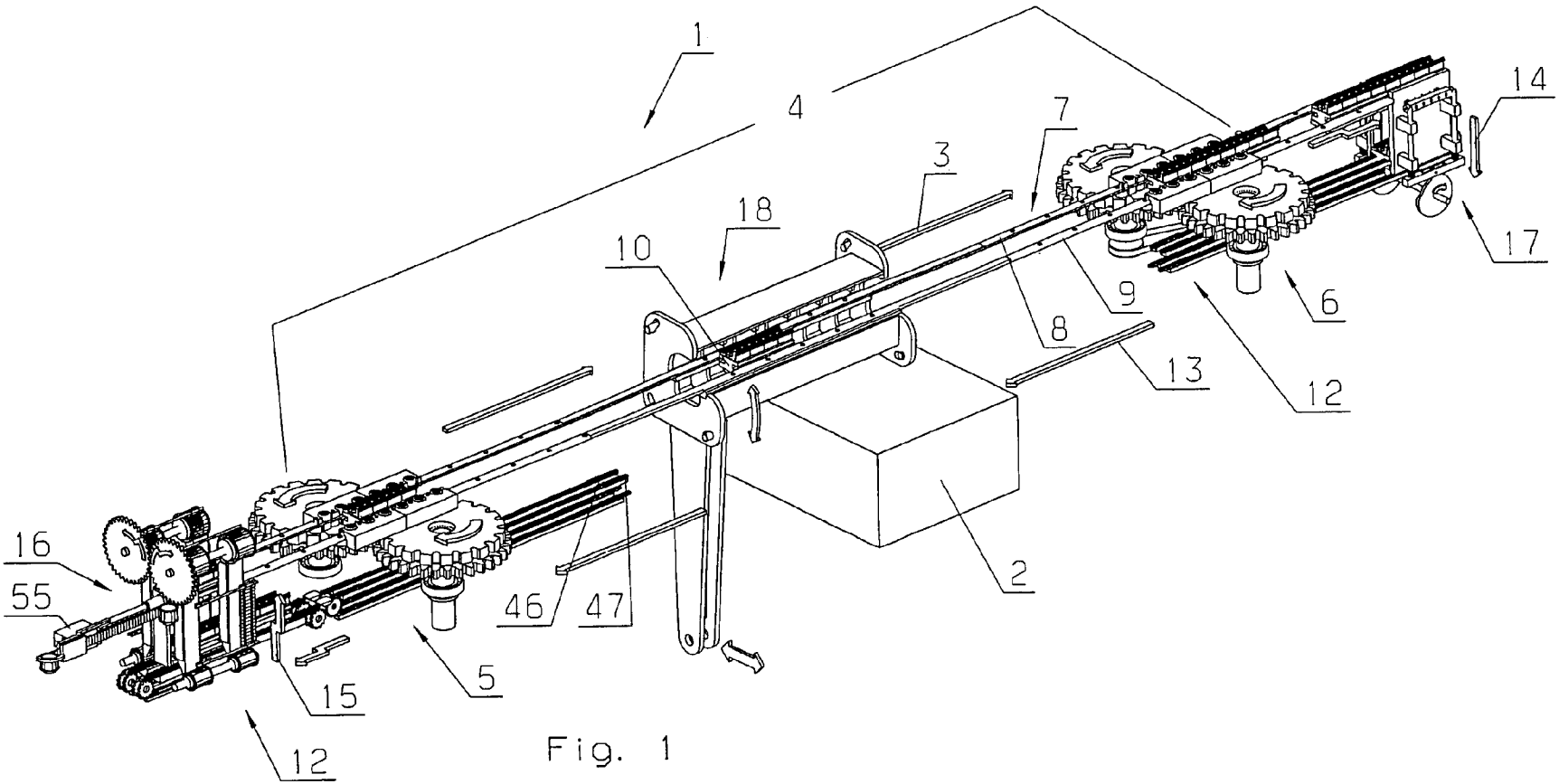
FIG. 1 diagrammatically illustrates a section of a knitting machine with weft feed.

FIG. 1 shows a knitting machine 1 with a knitting area 2 diagrammatically and merely in part. Knitting elements not shown in further detail are arranged in the knitting area, which knitting elements interact in order to form a knitted fabric from a plurality of threads fed in a parallel manner.

Figure 3:
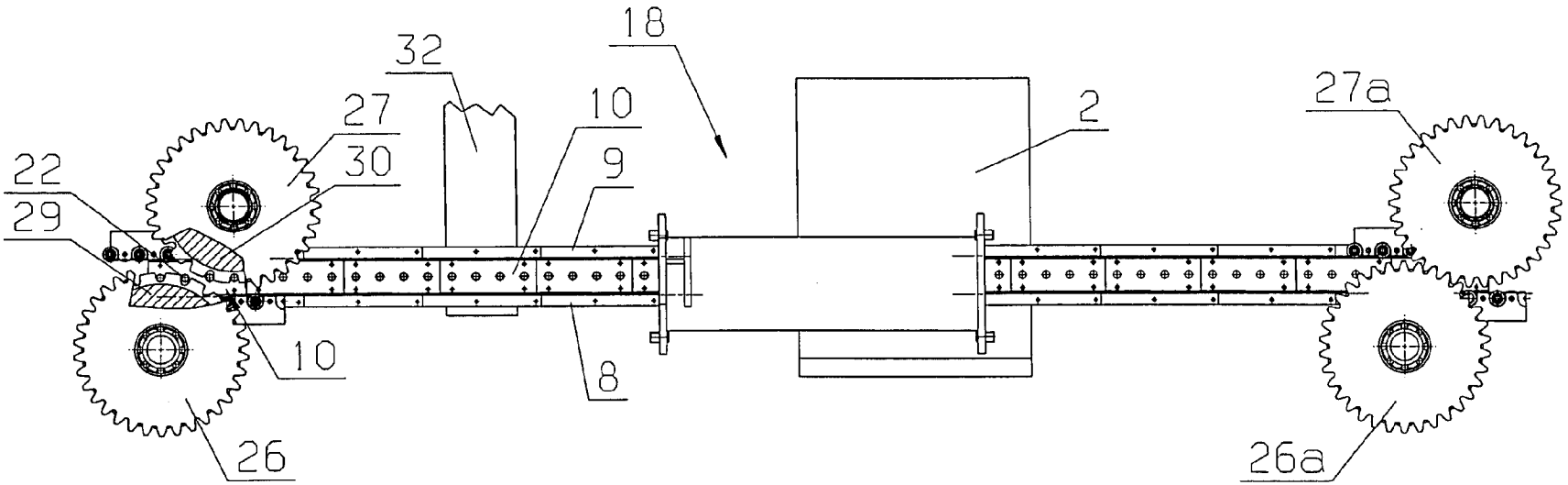
FIG. 3 illustrates a functional area from below.
Figure 4:
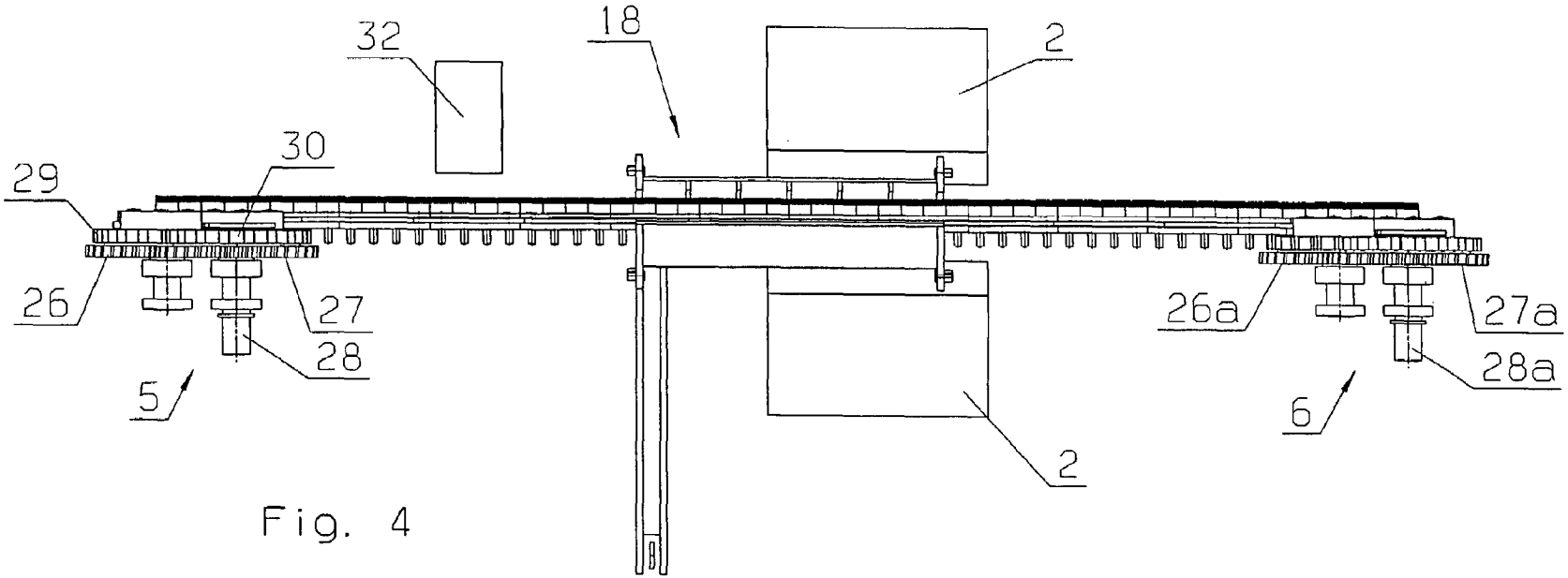
FIG. 4 illustrates the functional area in side view.

The knitting machine also has a weft feed device 32 (shown only diagrammatically in FIGS. 3 and 4) to deposit wefts on a conveyor device that will be described in more detail below. These wefts are then fed to the knitting area 2 in a transport direction 3. The wefts can thereby be arranged perpendicular to the transport direction 3. However, it is also possible to deposit the wefts at an angle of +45° or −45° or at any other angle to the transport direction 3. It is also possible to produce several groups of wefts with different angles to the transport direction 3, whereby all the wefts of all the weft groups are deposited on the conveyor device. In the latter case, this is called a multiaxial knitting machine.

Figure 2:
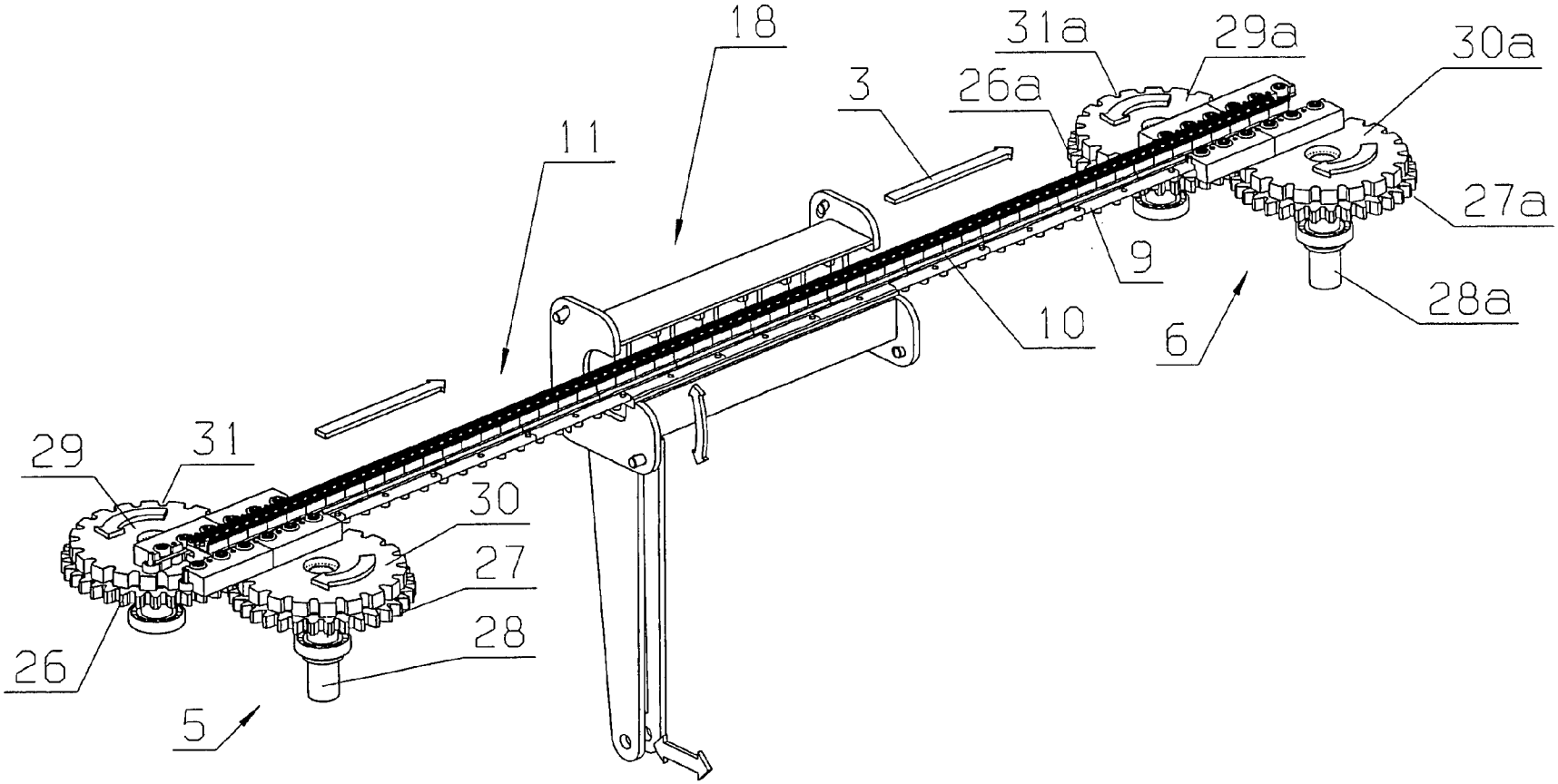
FIG. 2 illustrates an enlarged section showing a functional area.

The knitting machine 1 has a functional area 4 that represents the work area of knitting machine 1. This is where all the processes occur that are relevant in terms of textile technology. At its start, the functional area has an input drive 5 and at its end an output drive 6, which are connected to one another by a guide track 7. The guide track is formed by two rails 8, 9 guided in a parallel manner. During operation, transport elements 10 are guided on the rails, as can be seen in FIG. 2, in the form of a feed assembly 11. Guide track 7 at a side wall of knitting machine 1 is shown. A corresponding arrangement is located on the other side wall, if necessary, mirror-inverted.

A returning area 12 is arranged below functional area 4 so that transport elements 10 can be conveyed against transport direction 3, as indicated by an arrow 13. In this exemplary embodiment, returning area 12 is arranged below functional area 4. However, while advantageous, other arrangements are contemplated and can be utilized without departing from the scope of the invention. For example, returning area 12 can also be arranged laterally next to the functional area, or above, or laterally next to and above or below functional area 4.

In the arrangement of returning area 12 below functional area 4, at the transition from functional area 4 to returning area 12, transport elements 10 have to make a movement from above downwards (arrow 14) and at the transition from returning area 12 to functional area 4 a movement from below upwards (arrow 15). If returning area 12 is arranged in a different place with respect to functional area 4, the movement symbolized by arrows 14, 15 has to be changed accordingly. This movement can then also be made laterally.

A feeder device 16 is arranged before input drive 5 in the transport direction 3. A discharge device 17, which will be explained in more detail below, is arranged after output drive 6 in transport direction 3.

Figure 5:
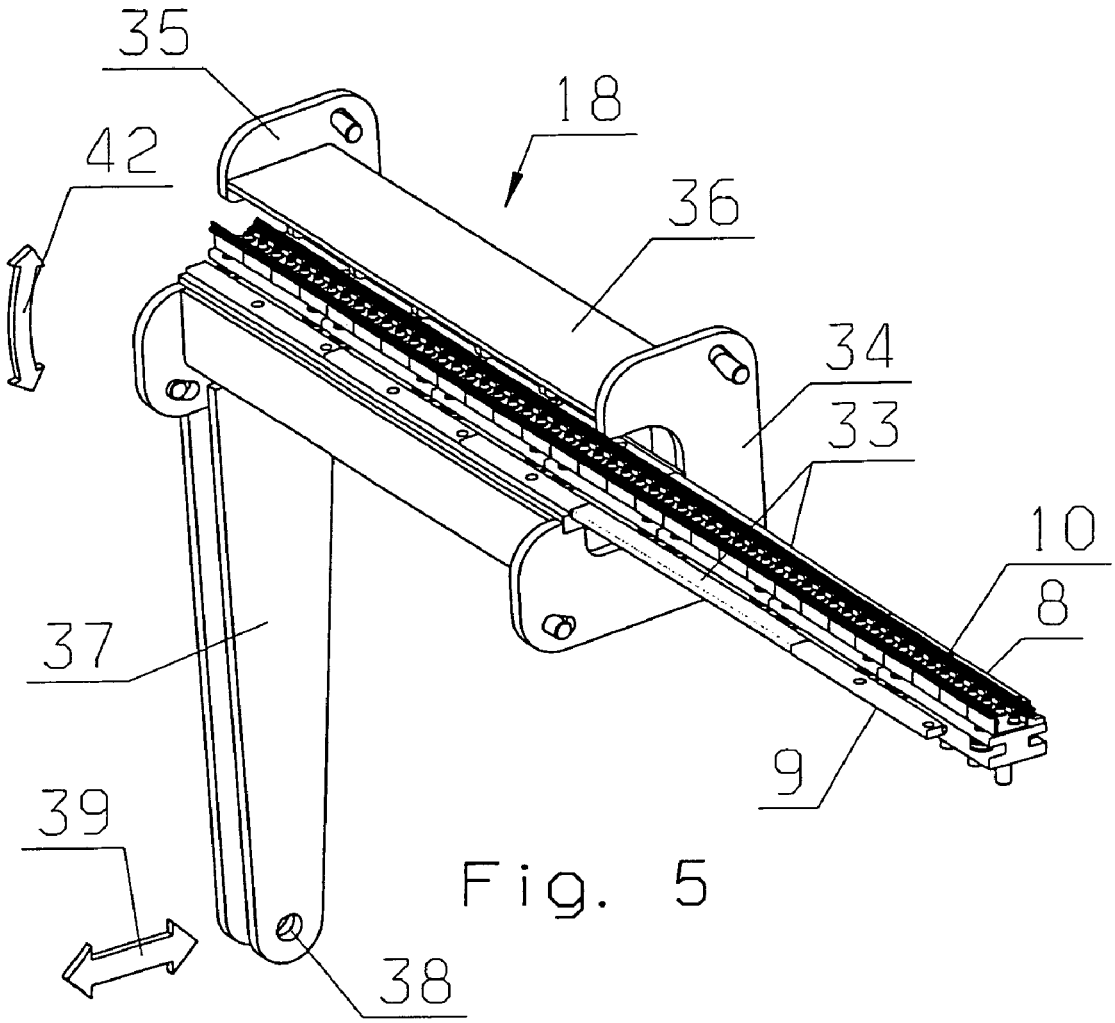
FIG. 5 diagrammatically illustrates of a control device in perspective view.
Figure 6:
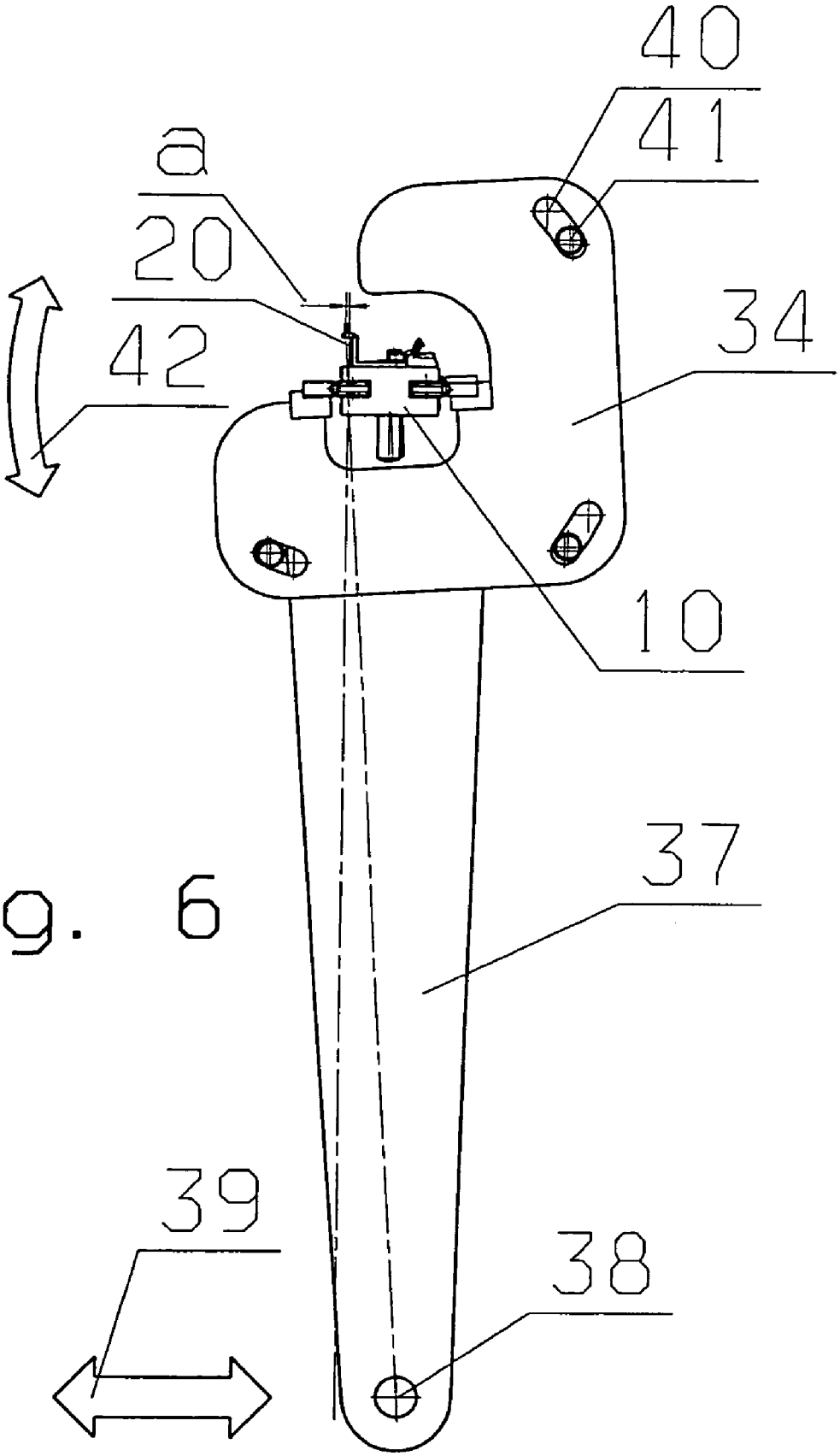
FIG. 6 illustrates the control device in front view.

A control device 18 is arranged inside functional area 4 to act on transport elements 10 in the present case, as will be explained in more detail in connection with FIGS. 5 and 6.

Figure 7:
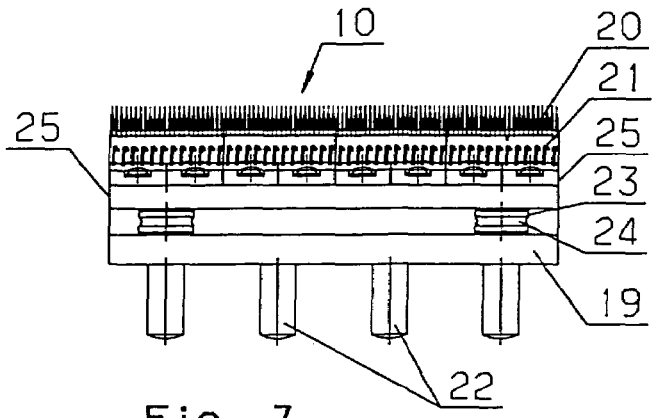
FIG. 7 illustrates a side view of a transport element.
Figure 8:
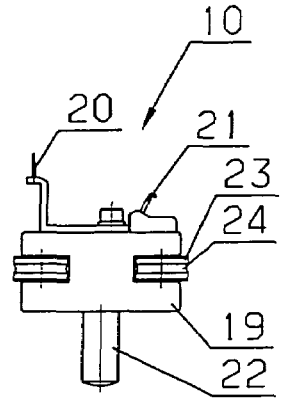
FIG. 8 illustrates a front view of the transport element.
Figure 9:
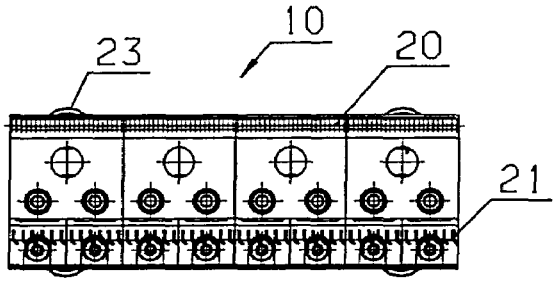
FIG. 9 illustrates a plan view of the transport element.
Figure 10:
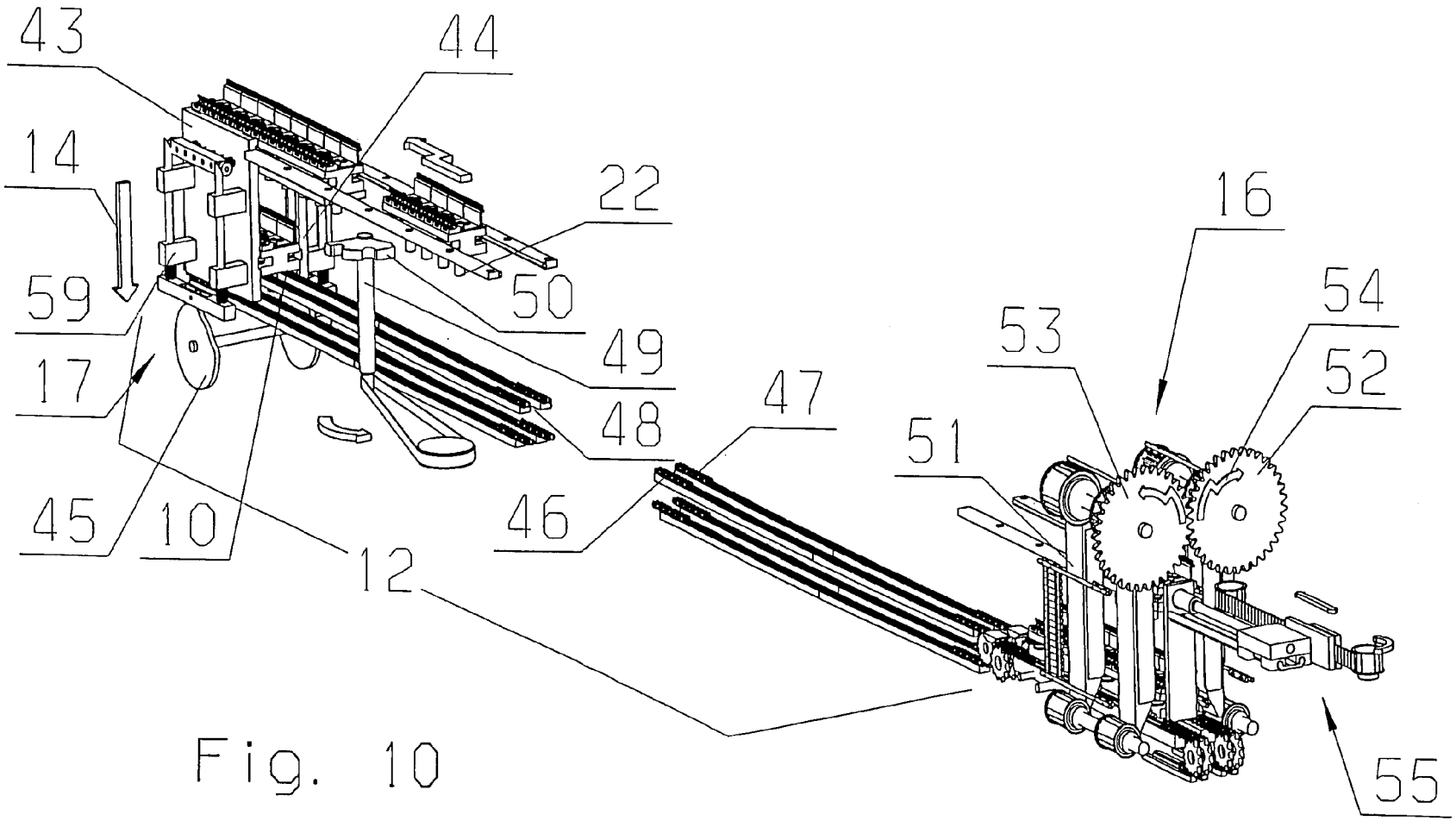
FIG. 10 illustrates a section showing the returning area.

FIGS. 7 through 9 show a transport element 10 with a body 19 which is formed, e.g., by an extruded profile. Two groups of thread holders 20, 21 are arranged with a uniform pitch on the top of body 19. Thread holders 20, 21 are shown here in the form of hooks. However, they can also have another form, e.g., clamps. Bolts 22 project on the base of body 19 can be used to drive transport elements 10.

Body 19 has guide rolls 23 projecting somewhat laterally, with which transport element 10 is guided in rails 8, 9. To this end, guide rolls 23 can have, e.g., a peripheral groove 24 so that transport element 10 is guided in rails 8, 9 not only laterally (left and right in FIG. 8), but also above and below (with respect to the representation in FIG. 8). Thus, as soon as transport element 10 has been accepted in guide track 7 formed by rails 8, 9, it has practically only one degree of freedom, i.e., the movement in transport direction 3. Otherwise, transport element 10 is supported in guide track 7 backlash-free.

All of the transport elements 10 that are used at the same time have the same length in transport direction 3. Preferably this length corresponds to an integer multiple of an inch. The spacings of bolts 22 are identical. The spacing of a bolt 22 from front faces 25 corresponds respectively to half of the spacing between two bolts 22. Accordingly, bolts 22 of all transport elements 10 in feed assembly 11 have the same spacing from one another, even if they belong to adjacent transport elements 10 that abut against one another by their front faces 25.

Input drive 5 and output drive 6 are structured in a similar manner. Input drive 5 has two gear wheels 26, 27 combing (enmeshing) with one another, in which one of the gear wheels 26, 27 is driven by a motor 28. Each gear wheel 26, 27 is connected in a torque-proof manner to a cylindrical lantern gear 29, 30. Each cylindrical lantern gear has recesses 31 that feature a spacing from one another in the circumferential direction that coincides with the spacing of bolts 22. The cylindrical lantern gears are thereby arranged laterally displaced to one another (see FIGS. 3 and 4) such that they act on bolts 22 of transport elements 10 in a straight line that is arranged in the middle between two rails 8, 9.

In a similar manner, output drive 6 also features a rack and pinion gearing, the detailed description of which has been dispensed with. The elements of output drive 6, which correspond to those of input drive 5, are labeled with the same reference numbers to which an "a" has been added.

The two drives 5, 6 are controlled in synchronism with one another. Motor 28 of input drive 5 works with a somewhat greater torque than motor 28*a* of output drive 6. This means that transport elements 10 between input drive 5 and output drive 6 are pressed against one another and thus form feed assembly 11. The individual transport elements 10 are thereby arranged one behind the other backlash-free. Since they are also held backlash-free in rails 8, 9, they are fed to knitting area 2 with relatively great precision. The wefts which have been deposited on the transport elements by a weft layer 32 (FIGS. 3 and 4), shown only diagrammatically, are also fed with the same precision.

The wefts deposited on transport elements 10 with the aid of weft layer 32 (a guide track 7 with corresponding transport elements 10 in feed assembly 11 is naturally provided on both sides of knitting area 2 parallel to transport direction 3) have to be changed in their tension occasionally before they enter knitting area 2 and there become part of a knitted fabric. Control device 18 is provided to this end, which will be explained in more detail in connection with FIGS. 5 and 6.

Rails 8, 9 have an elastically deformable area 33 in the area of control device 18. Also in this area 33, rails 8, 9 remain parallel with a constant spacing, for example, with the aid of bearers (not shown in further detail). Control device 18, which features two G-shaped plates 34, 35 connected to one another by a cover 36 running parallel to transport direction 3 and partially open, acts on this elastically deformable area 33. A lever 37, which acts on one of plates 35, has a lower end 38 that is adjustable in the direction of an arrow 39 crosswise to the transport direction 3, for example, through a worm gear (not shown in further detail).

Plates 34 have slots 40 with which they are supported on bolts 41. Therefore, if lower end 38 of lever 37 is moved in the direction of the arrow 39, a swiveling of plates 34 results in the direction of an arrow 42 by a relatively limited angle. The angle is normally less than 5°. This slight swiveling causes thread holders 20 at the top of transport element 10 to be displaceable by a distance a that is no more than ±2.5 mm starting from a neutral position. The height displacement of the thread holders 20 is thereby extraordinarily small. In this case, it is only 8/100 mm. With a swiveling of lever 37, neither the positive engagement of feed assembly 11 nor the form closure of transport elements 10 with guide track 7 is broken. Despite the action of control device 18, the freedom of movement in feed assembly 11 is maintained.

When plates 34 are swiveled clockwise (based on the representation of FIG. 6), an increase of the thread tension of the wefts results. With a swiveling in the opposite direction, a reduction of the tension results.

The thread tension can also be changed by other elements or devices without departing from the spirit and scope of the invention. For example, thread holders 20, 21 can be arranged on transport elements 10 in a moveable manner. A guide can be provided on transport elements 10, for example, with which guide thread holders 20, 21 can be displaced crosswise to the transport direction 3. Thread holders 20, 21 can also be supported on transport element 10 so they can be swiveled, so that the same effect results as in the representation of FIGS. 5 and 6. The action on rails 8, 9, however, has the advantage that transport elements 10 do not have to be reset after passing through control device 18, instead the return to the neutral position occurs automatically in that transport elements 10 again reach areas of rails 8, 9 which are arranged in a fixed manner. Elastically deformable area 33 of rails 8, 9, however, is still located at the level of knitting area 2, so that the effect of control device 18 occurs in knitting area 2.

Discharge device 17 is arranged behind output drive 6 in transport direction 3, with which discharge device transport elements 10 which have passed through output drive 6 are conveyed downwards in the direction of arrow 14. To this end, discharge device 17 has two fixed profiled guide rails 43, 44 in which two extendible winding guides 59 are embedded and on which a transport device can be loaded. Through an opening and closing of the winding guides 59 synchronized with the transport process, triggered by a control cam 45, the inserted transport element 10 is brought into the conveyor area through the effect of gravity. The transport element thereby falls on dampers (not shown) and is then deposited on belts 46, 47. Depositing the transport element resting on the damping device can likewise occur via another control cam arranged parallel to the control cam 45. Belts 46, 47 run from discharge device 17 to feeder device 16. A gap 48 is embodied between the two belts 46, 47, in which gap the bolts 22 of transport elements 10 can engage. Belts 46, 47 rotate at a constant speed. This speed is much greater than the speed at which the transport elements 10 in feed assembly 11 move in functional area 4. Belts 46, 47 carry along transport elements 10 through friction.

A feed limiting device 49 is provided with a drive segment 50 that can act on bolts 22 of a transport element 10. Feed limiting device 49 is arranged at the level of guide track 7 and ensures that only always one transport element 10 at a time can reach discharge device 17. The function of feed limiting device 49 arranged in the area of the guide track and after output drive 6, is to separate two transport elements 10 spatially from one another with the following objectives:

- Breaking a mechanical coupling due to thread remnants not completely removed which can remain in the thread holder after the separation of the scrim from the thread holder and can thus connect two or more transport elements mechanically.
- Producing a "time window" or defined stoppage time of one or more transport element(s) 10 after insertion in discharge device 17.
- Breaking the positive engagement, which can also be caused by friction, between the transport elements so that a simple "further transport" is possible.

Feeder device 16 has a vertical conveyor 51 with which one transport element 10 respectively can be lifted from belts 46, 47 and raised to the level of guide track 7. Vertical conveyor 51 is formed, e.g., by a total of four toothed belts, located in front and behind in transport direction 3 and in pairs left and right of transport element 10. These toothed belts are driven in synchronism with one another by a suitable drive and via combing gear wheels 52, 53, whereby gear wheels 52, 53 when lifted are rotated in the direction of arrows 54.

As soon as a transport element has reached the level of the guide track 7, a linear drive 55 is actuated which moves a transport element 10 in transport direction 3 towards input drive 5 so that transport element 10 engages with cylindrical lantern gears 29, 30 of intake gear 5. Intake gear 5 then pushes this transport element 10 on guide track 7 further in transport direction 3, whereby this transport element 10 is then again part of feed assembly 11.

Transport elements 10 are thus guided through knitting machine 1 in a closed cycle. As long as they are carrying wefts, they are guided in a feed assembly 11 held together in a non-positive manner. When they are no longer carrying any threads, they can be transported individually at higher speed. However, the alignment of transport elements 10 in the space remains unchanged, i.e., thread holders 20, 21, for example, are always directed upwards.

In a manner not shown in further detail, discharge device 17 can also be provided with a device to remove from transport elements 10 remnants of wefts that still remain on thread holders 20, 21 after leaving the knitting area.

Since a force no longer acts on the front end of the transport element 10 in transport direction 3 in discharge device 17, i.e., after leaving output drive 6, the positive engagement in feed assembly 11 is broken, so that transport elements 10 can be conveyed downwards solely under the weight of gravity, i.e., without the exertion of greater external forces.

Feeder device 16 with its linear drive 55 is expediently coordinated with input drive 5, i.e., a transport element 10 is fed to input drive 5 only when a corresponding space is available to accept a transport element 10. Otherwise, transport elements 10 could very well accumulate on belts 46, 47 in front of feeder device.

In the returning area 12 there is definitely the possibility of removing individual transport elements 10 or also all transport elements 10 and replacing them with other transport elements 10. If necessary, switch points or sluices and, if necessary, magazine devices can be provided here which, however, are not shown in further detail for reasons of clarity.

In the embodiment shown in FIGS. 1 through 10, feed assembly 11 is realized in that two drives 5, 6 act with slightly different momentums on transport elements 10.

Figure 11:
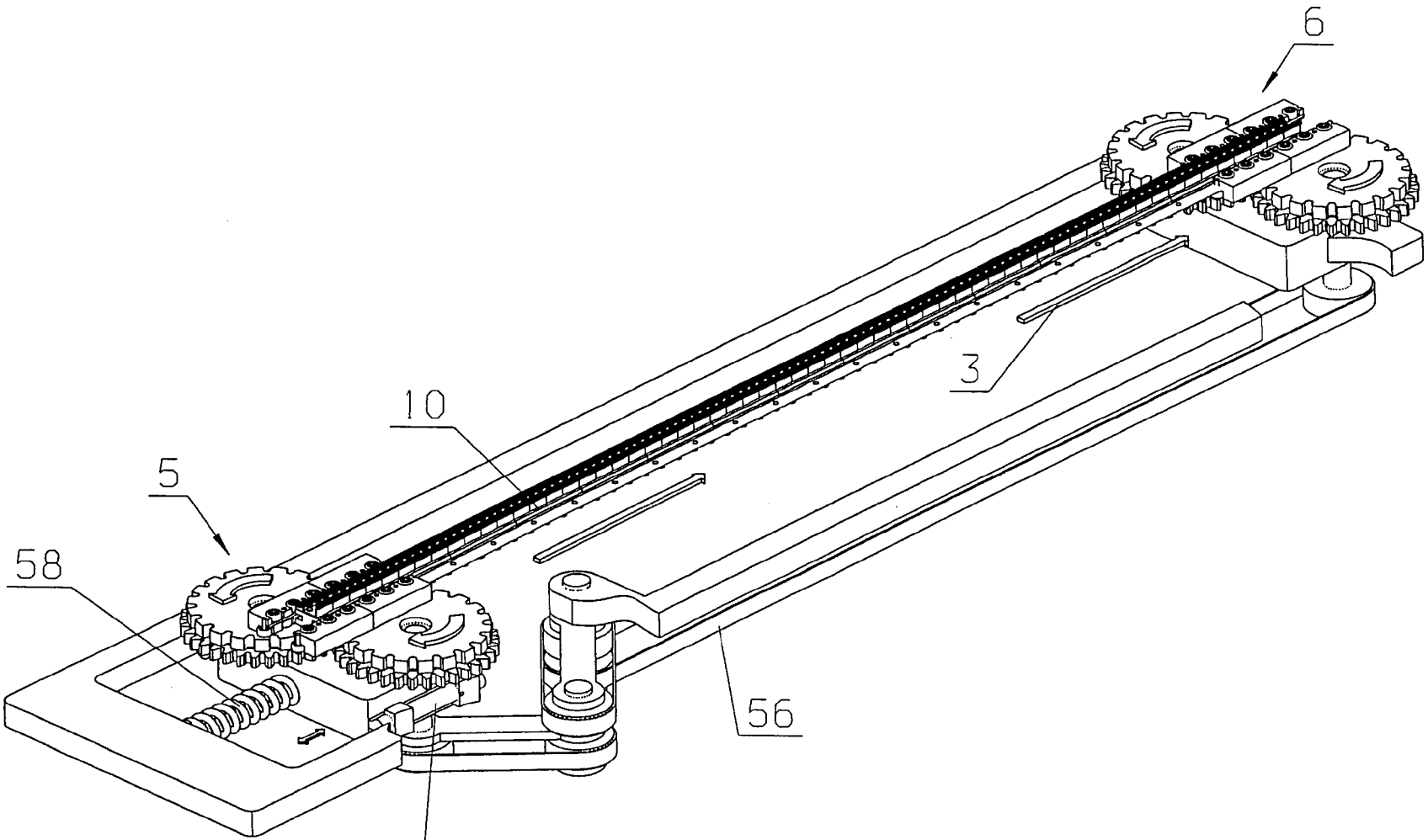
FIG. 11 illustrates an alternative embodiment of a drive device.

In a modified embodiment which is shown diagrammatically in FIG. 11, input drive 5 and output drive 6 are driven via a common drawing device 56. They thus have the same momentum. In order to nevertheless exert the necessary force in transport direction 3 on transport elements 10, the input drive is arranged on a moveable carrier 57 which is loaded with the aid of a spring 58 in the direction of output drive 6. With the aid of spring 48, carrier 57 of input drive 5 is displaced in the direction of output drive 6 such that the individual transport elements 10 always rest against one another by their front faces. Spring 58 is also able to absorb small differences in length between transport elements 10.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A knitting machine with a knitting area and a weft feed device, comprising:

a conveyor device structured and arranged to feed wefts to the knitting area in a transport direction;

said conveyor device comprising several transport elements with thread holders; and said transport elements being separate from one another and joinable to form a feed assembly through a functional area in the transport direction and separable to be individually movable in a returning area.

2. The knitting machine in accordance with claim 1, wherein said transport elements are conveyed in a closed cycle.

3. The knitting machine in accordance with claim 1, wherein said transport elements are moved at a higher speed in said returning area than in said functional area.

4. The knitting machine in accordance with claim 1, wherein the transport elements have a same alignment in said functional area and in said returning area.

5. The knitting machine in accordance with claim 1, wherein said functional area is arranged above said returning area.

6. A knitting machine with a knitting area and a weft feed device, comprising:

a conveyor device structured and arranged to feed wefts to the knitting area in a transport direction;

said conveyor device comprising several transport elements with thread holders;

said transport elements being separate from one another and joinable to form a feed assembly through a functional area in the transport direction and individually movable in a returning area; and a guide track arranged to extend through said functional area, wherein said transport elements are guided in said guide track at least in said functional area.

7. A knitting machine with a knitting area and a weft feed device, comprising:

a conveyor device structured and arranged to feed wefts to the knitting area in a transport direction;

said conveyor device comprising several transport elements with thread holders;

said transport elements being separate from one another and joinable to form a feed assembly through a functional area in the transport direction and individually movable in a returning area; and at least one control device arranged in said functional area, said control device being structured and arranged to change a position of said thread holders essentially crosswise to the transport direction.

8. The knitting machine in accordance with claim 7, wherein said thread holders are movably arranged on said transport element.

9. The knitting machine in accordance with claim 7, wherein said transport element comprises at least one thread holder guide running crosswise to said transport direction.

10. The knitting machine in accordance with claim 7, wherein said control device rotates said transport element about an axis that runs parallel to said transport direction.

11. The knitting machine in accordance with claim 6, wherein said control device is structured and arranged to act on said guide track.

12. A knitting machine with a knitting area and a weft feed device, comprising:

a conveyor device structured and arranged to feed wefts to the knitting area in a transport direction;

said conveyor device comprising several transport elements with thread holders; and said transport elements being separate from one another and joinable to form a feed assembly through a functional area in the transport direction and individually movable in a returning area;

wherein an input drive is arranged at a start of the functional area relative to the transport direction and an output drive is arranged at an output of the functional area relative to the transport direction, such that said input drive and said output drive respectively act on at least one of said transport elements at a start and at an end of said feed assembly.

13. The knitting machine in accordance with claim 12, wherein said input drive and said output drive act with differing forces in the transport direction on the feed assembly.

14. The knitting machine in accordance with claim 12, wherein said input drive and said output drive are displaceable with respect to one another.

15. The knitting machine in accordance with claim 12, wherein at least one of said input drive and said output drive comprises a meshing geometry with a rack and pinion gearing.

16. The knitting machine in accordance with claim 15, wherein each said transport element comprises at least one projecting bolt.

17. The knitting machine in accordance with claim 12, further comprising a returning device, arranged in said returning area, structured and arranged to act with friction engagement on said transport elements.

18. The knitting machine in accordance with claim 12, further comprising an unloading device, arranged at the output of the output drive, structured and arranged to detach a transport element from said feed assembly through a change in a direction of movement.

19. The knitting machine in accordance with claim 18, further comprising a feed limiting device coupled to said unloading device.

20. The knitting machine in accordance with claim 12, further comprising a feeder device, arranged before said input of said input drive, structured and arranged to engage a transport element with said input drive.

21. The knitting machine in accordance with claim 20, wherein said feeder device is synchronized with said input drive.

22. A knitting process comprising:

conveying a plurality of transport elements with thread holders joined together to form a feed assembly through a functional area in a transport direction; and individually moving said transport elements in a return direction in a returning area.

* * * * *